US010122079B2

(12) United States Patent
Orem et al.

(10) Patent No.: US 10,122,079 B2
(45) Date of Patent: Nov. 6, 2018

(54) THERMALLY STABLE SEALED BLIND MATE CONNECTOR MOUNTING

(71) Applicant: CommScope Technologies LLC, Hickory, NC (US)

(72) Inventors: John W. Orem, Allen, TX (US); Eddie R. Bradley, Allen, TX (US); Khanh Duy Tran, Rowlett, TX (US)

(73) Assignee: CommScope Technologies LLC, Hickory, NC (US)

( * ) Notice: Subject to any disclaimer, the term of this patent is extended or adjusted under 35 U.S.C. 154(b) by 38 days.

(21) Appl. No.: 15/515,471

(22) PCT Filed: Oct. 28, 2015

(86) PCT No.: PCT/US2015/057746

§ 371 (c)(1),
(2) Date: Mar. 29, 2017

(87) PCT Pub. No.: WO2016/069710

PCT Pub. Date: May 6, 2016

(65) Prior Publication Data

US 2017/0214133 A1 Jul. 27, 2017

Related U.S. Application Data

(60) Provisional application No. 62/072,078, filed on Oct. 29, 2014.

(51) Int. Cl.
*H01Q 1/02* (2006.01)
*H01Q 1/42* (2006.01)
(Continued)

(52) U.S. Cl.
CPC ..... *H01Q 1/427* (2013.01); *H01Q 1/1207* (2013.01); *H01Q 15/14* (2013.01)

(58) Field of Classification Search
CPC ..... H01R 13/52; H01R 25/00; H01Q 1/50; H01Q 1/1228; H01Q 1/125; H01Q 1/246; H01Q 19/30; H01Q 9/30
(Continued)

(56) References Cited

U.S. PATENT DOCUMENTS 6,275,197 B1 * 8/2001 Behr ..... H01Q 1/1207 343/872
8,698,682 B1 * 4/2014 Desclos ..... H01Q 9/42 343/745
(Continued)

OTHER PUBLICATIONS

International Search Report and Written Opinion of the International Searching Authority, International Application No. PCT/US2015/057746, dated Jan. 26, 2016.

*Primary Examiner* — Linh Nguyen
(74) *Attorney, Agent, or Firm* — Myers Bigel, P.A.

(57) ABSTRACT

A connector assembly for an antenna which includes an antenna cover. The connector assembly includes a connector mount with one or more connectors and a connector housing enclosing the connectors. The connector mount extends through an opening in the antenna cover with sufficient clearance to allow movement due to difference in thermal expansion between the antenna cover and the antenna structure. The assembly also includes a flexible seal structure attached to the connector mount and attachable to the antenna cover and dimensioned to enclose a portion of the connector mount extending outside the antenna cover to form a flexible weather resistant seal between the antenna cover and the connector mount while allowing movement of the connector mount relative to the antenna cover.

19 Claims, 4 Drawing Sheets

(51) Int. Cl.
*H01Q 15/14* (2006.01)
*H01Q 1/12* (2006.01)

(58) Field of Classification Search
USPC ..... 343/702, 704, 718
See application file for complete search history.

(56) References Cited

U.S. PATENT DOCUMENTS

| | | | | |
|---|---|---|---|---|
| 9,172,421 | B2 * | 10/2015 | Colapietro | H04B 1/40 |
| 9,249,593 | B2 | 2/2016 | Perko et al. | |
| 9,660,328 | B2 * | 5/2017 | Wild | H01Q 1/246 |
| 2005/0168385 | A1 | 8/2005 | Baker | |
| 2008/0169996 | A1 | 7/2008 | Yang | |
| 2010/0079346 | A1 * | 4/2010 | Olson | H01Q 1/12 343/702 |
| 2010/0201590 | A1 * | 8/2010 | Girard | H01Q 1/246 343/766 |
| 2011/0226972 | A1 * | 9/2011 | Pang | G01B 9/04 250/578.1 |
| 2012/0146876 | A1 * | 6/2012 | Yang | H01Q 1/2283 343/848 |
| 2014/0118196 | A1 | 5/2014 | Koskiniemi | |
| 2014/0145970 | A1 * | 5/2014 | Cho | G06F 3/016 345/173 |
| 2015/0380806 | A1 * | 12/2015 | Wild | H01Q 1/246 343/906 |
| 2016/0352042 | A1 * | 12/2016 | Wankoff | H01Q 1/1228 |
| 2018/0151960 | A1 * | 5/2018 | Scheucher | H01Q 19/30 |

* cited by examiner

THERMALLY STABLE SEALED BLIND MATE CONNECTOR MOUNTING

CROSS REFERENCE TO RELATED APPLICATIONS

This application is a 35 U.S.C. § 371 national stage application of PCT International Application No. PCT/US2015/057746, filed Oct. 28, 2015, which itself claims priority to the following U.S. Provisional Application pursuant to 35 U.S.C. § 120, U.S. Provisional Application Ser. No. 62/072,078 filed Oct. 29, 2014, the disclosure and content of both of which are incorporated by reference herein in their entireties. The above-referenced PCT International Application was published in the English language as International Publication No. WO 2016/069710 A1 on May 6, 2016.

BACKGROUND

The present inventions relate generally to wireless communications antenna systems. In particular, they relate to improvements in wireless base station antenna connector mountings.

Mobile wireless access antennas, such as cellular sector antennas, are deployed in severe environmental conditions. The operational temperature range for such antennas is typically −40° C. to +70° C., and the antennas are rated to endure wind speeds of up to 240 km/h. Environmental sealing must be maintained through these weather extremes.

In known antennas, RF connectors are often located on a bottom panel, and are connected to coaxial cables one at a time. However, a recent development involves defining an interface with pre-determined locations for blocks of RF connectors, to allow for interconnection of equipment without having to field-install coaxial cable jumpers. See, for example, U.S. application Ser. No. 14/224,369, now U.S. Pat. No. 9,249,593 to Perko et al., which is incorporated by reference. These pre-determined locations for these blind mate blocks of RF connectors must be thermally stable.

SUMMARY OF THE INVENTION

A connector assembly for an antenna including an antenna cover according to one aspect of the invention includes a connector mount attachable to an inner structure of the antenna which extends through an opening in the antenna cover with sufficient clearance to permit movement of the antenna cover relative to the connector mount. A sealing structure dimensioned to enclose at least a portion of the connector mount forms a flexible weather resistant seal between the antenna cover and the connector mount that allows movement of the antenna cover relative to the connector mount.

DESCRIPTION OF EXAMPLES OF THE INVENTION

The present invention is described herein with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Many different embodiments are disclosed herein, in connection with the description and the drawings. It will be understood that it would be unduly repetitious and obfuscating to literally describe and illustrate every combination and subcombination of these embodiments. Accordingly, the present specification, including the drawings, shall be construed to constitute a complete written description of all combinations and sub combinations of the embodiments described herein, and of the manner and process of making and using them, and shall support claims to any such combination or subcombination.

Figure 1:
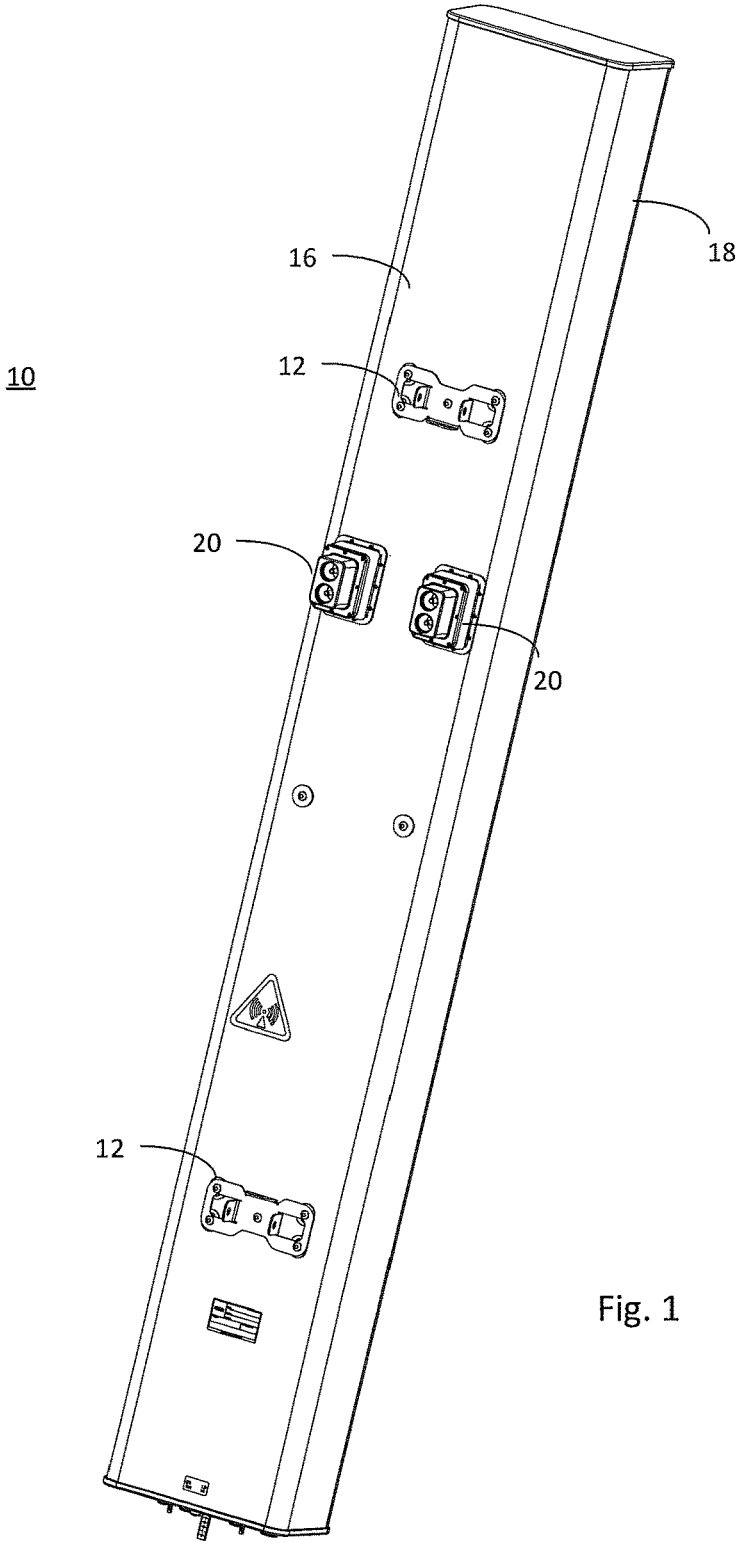
FIG. 1 is a back view of a first example of a mobile wireless access antenna assembly according to one embodiment of the present invention.

FIG. 1 illustrates a back view of an example of a mobile wireless access antenna 10. The antenna 10 comprises lower and upper mounting brackets 12, a rear cover 16, a radome (front cover) 18, one or more blind mate connector blocks 20, and a reflector 22 (FIG. 2), which also serves a frame for the antenna 10. The rear cover 16 and the radome 18 together form an antenna cover.

The reflector 22 is typically fabricated from metal, such as aluminum or steel. The rear cover 16 and radome 18 may be fabricated from a thermo plastic, such as Acrylonitrile Styrene Acrylate (ASA). In a one embodiment, the rear cover 16 and radome 18 comprise a single extrusion. In an alternate embodiment, the rear cover 16 and radome 18 may be separately formed and may be fastened to the reflector or other antenna structure.

Figure 2:
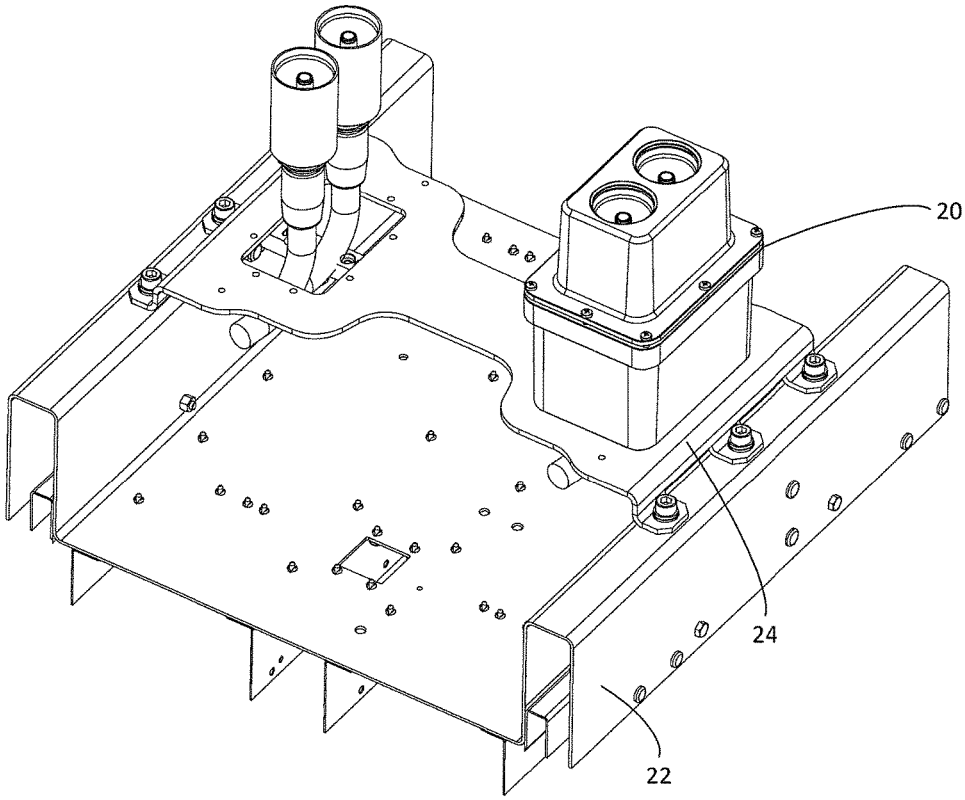
FIG. 2 is a view of the back of the antenna with the rear cover removed illustrating one embodiment of a connector according to the first example of the present invention.

Referring to FIG. 2, a view of the back of the antenna with the rear cover removed is illustrated. The connector blocks 20 are mounted to an inner structure of the antenna such as bracket 24, which is in turn mounted to the reflector 22, as shown, or to another antenna structure. Referring to FIGS. 3 and 4, the connector blocks 20 protrude through openings 32 in the rear cover 16.

The coefficient of thermal expansion (CTE) of the ASA radome/rear cover may be approximately 95×10-6/° C., whereas the CTE for the reflector are may be as little as 13×10-6/° C., depending on the metal used for the reflector 22 and the structure on which the antenna is mounted. This mis-match in the rate of expansion of the two components means that adequate clearance must be provided at the openings in the rear cover 16 for the greater rate of expansion of the rear cover 16 relative to the reflector 22. (The relatively high CTE for the rear cover 16 precludes attaching the connector blocks directly to the rear cover, as that may cause misalignment of the connector blocks relative to the mounting brackets of the antenna.) Accordingly, according to one aspect of the present invention, the connector blocks 20 are environmentally sealed to the rear cover with a flexible seal structure 40, while the connector blocks themselves are fixed to the reflector.

Figure 3A:
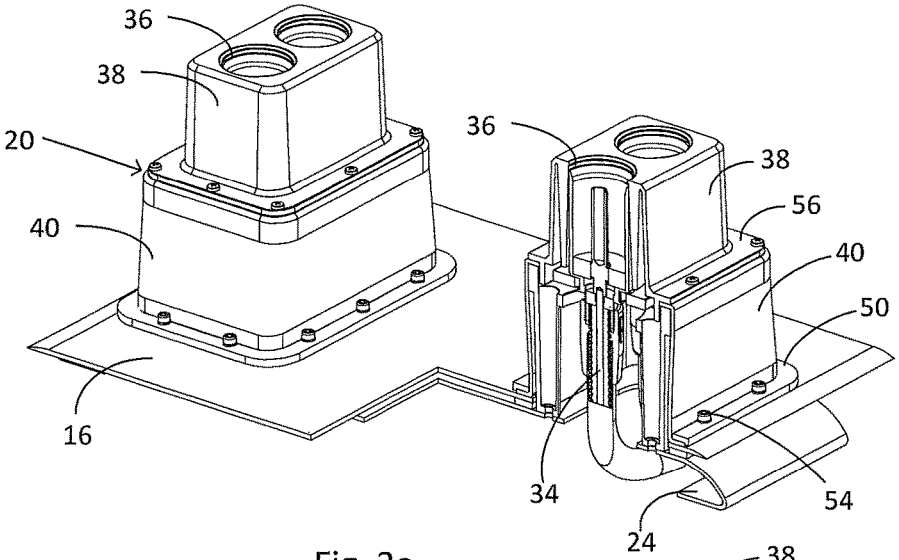
FIG. 3*a* is a view illustrating two connector blocks including a cut-away view adapted for use in the first example of the present invention.
Figure 3B:
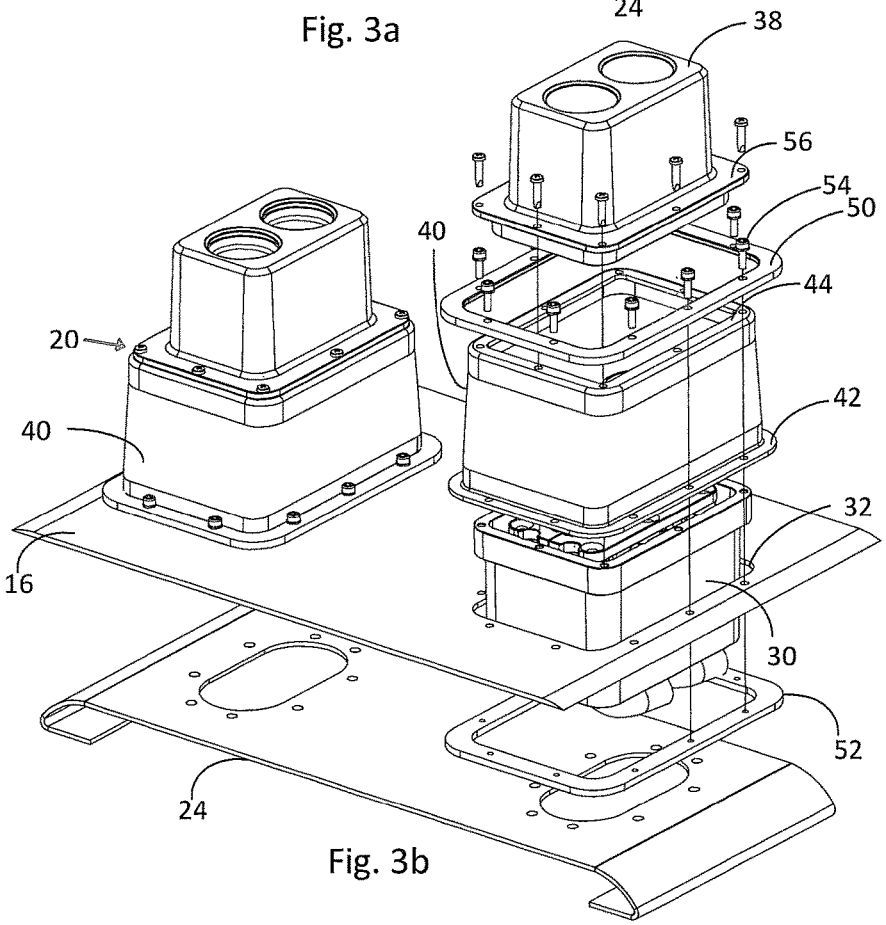
FIG. 3*b* is an alternative view of the two connector blocks of FIG. 3*a* including an exploded view adapted for use in the first example of the present invention.

FIG. 3*a* illustrates two connector blocks 20, with one providing a cut-away view. FIG. 3*b* illustrates the same two connector blocks 20, with one providing exploded view. A connector block 20 includes a connector mount 30, which is mounted to the bracket 24. The connector mount 30 extends through an opening 32 in the rear cover 16. The connector mount 30 includes a coaxial cable to connector terminations 34. On top of the connector mount 30 is mounted a pair of capacitive RF connectors 36. (Greater or fewer connectors may be employed as may be needed in any given application). The RF connectors 36 are housed within a connector housing 38.

Also shown in FIG. 3*a* is an example of the seal 40. The seal may be a weather resistant elastomer, and is dimensioned to enclose the portion of the connector mount that extends above the rear cover. The seal 40 forms a weather resistant seal between the rear cover 16 and the portion of the connector block 20 outside of the antenna rear cover 16. The seal 40 in the examples of FIG. 3*a* and FIG. 3*b* has a lower flange 42, which is clamped to the rear cover 16 by upper and lower compression plates 50, 52 and threaded fasteners 54. In the example of FIGS. 3*a* and 3*b*, the seal 40 also has an upper flange 44 which is clamped to the top of the connector mount 30 by a flange 56 on the connector housing and by threaded fasteners 59.

Figure 4A:
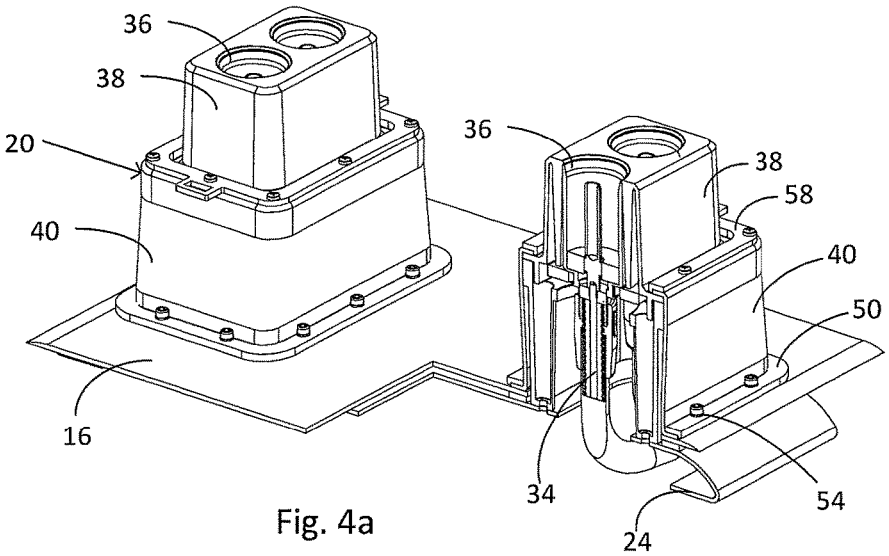
FIG. 4*a* is a view of an alternative embodiment of two connector blocks, including a cut-away view adapted for use in the first example of the present invention.
Figure 4B:
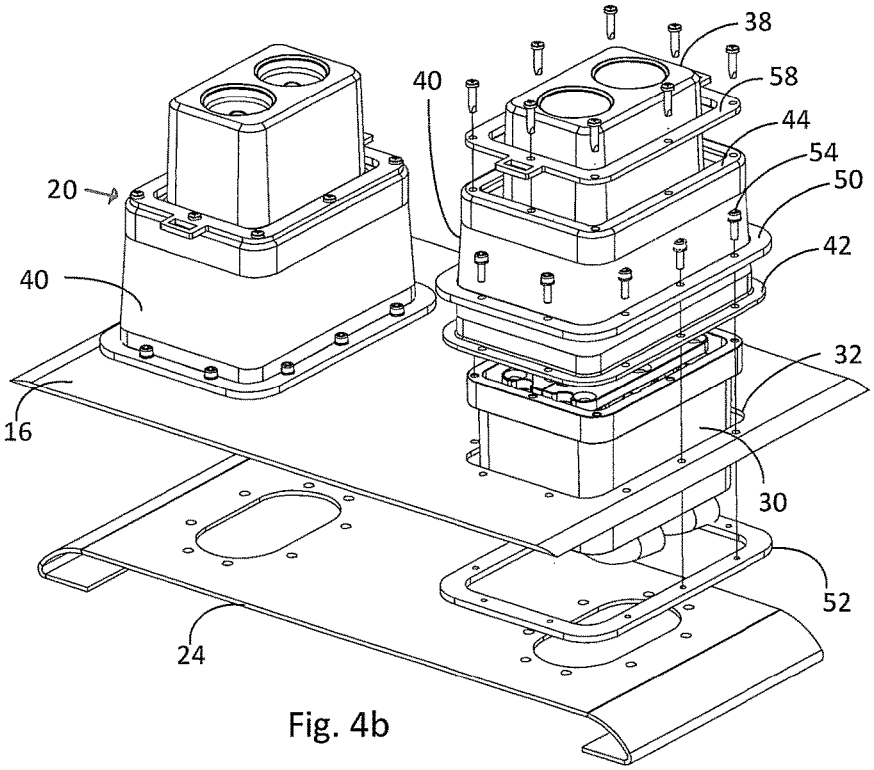
FIG. 4*b* is an alternative view of the two connector blocks of FIG. 4*a* including an exploded view adapted for use in the first example of the present invention.

FIGS. 4*a* and 4*b* illustrate an alternate embodiment of the connector blocks 20. Where the structure is the same as the previous example, the same reference characters are used and the description is not repeated. In the example of FIGS. 4*a* and 4*b*, the seal 40 also has an inward turned flange 44. However, in this example, the connector housing 38 is set on top of the connector mount 30, the inward flange 44 of the seal 40 overlaps a flange on the connector housing 38, and a compressor plate 58 clamps the upper flange of the seal to the connector housing.

When assembled, clearance between the rear cover 16 and connector mounts allows sufficient room for movement of the rear cover relative to the connector mount. However, the seal, being clamped at one end to the rear cover, and clamped at the other end to the connector block, provides weather resistant environmental sealing without restricting movement of the connector block relative to the rear cover.

Although embodiments of the present invention have been described with reference to specific example embodiments, it will be evident that various modifications and changes may be made to these embodiments without departing from the broader spirit and scope of the invention. Accordingly, the specification and drawings are to be regarded in an illustrative rather than a restrictive sense and it is intended that the invention be limited only to the extent required by the appended claims and the applicable rules of law.

The Abstract of the Disclosure is provided to comply with 37 C.F.R. § 1.72(b), requiring an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter may lie in less than all features of a single disclosed embodiment. Thus, the following claims are hereby incorporated into the Detailed Description, with each claim standing on its own as a separate embodiment.

What is claimed is:

1. A connector assembly, for an antenna including an antenna cover, comprising:

a connector block attachable to an inner structure of the antenna, the connector block including a connector mount, having at least one connector and configured to extend through an opening in the antenna cover and having a connector housing attached to the connector mount to enclose the at least one connector, the opening providing clearance sufficient to allow for movement of the antenna cover relative to the connector mount due to a difference in coefficient of thermal expansion of the antenna cover and the inner antenna structure; and a flexible sealing structure attached to the connector mount and attachable to the antenna cover and dimensioned to enclose at least a portion of the connector mount that extends outside of the antenna cover so as to form a flexible weather resistant seal between the antenna cover and the connector mount while allowing movement of the antenna cover relative to the connector mount.

2. The connector assembly of claim 1 wherein the flexible sealing structure comprises a weather resistant elastomer.

3. The connector assembly of claim 1 wherein the connector mount is configured to attach to a metal reflector within the antenna cover serving as a frame for the antenna.

4. The connector assembly of claim 3 wherein the connector mount is configured to be attached to the reflector by being mounted on a bracket attached to the reflector.

5. The connector assembly of claim 1 wherein the antenna cover is a single extrusion, thermoplastic cover and the flexible sealing structure is attachable to the thermoplastic cover.

6. The connector assembly of claim 3 wherein the antenna cover has a separately formed rear cover attached to the reflector and wherein the flexible sealing structure is attachable to the rear cover.

7. The connector assembly of claim 1 further comprising a plurality of connectors.

8. The connector assembly of claim 1 wherein the flexible sealing structure further comprises a lower flange which is configured to be clamped to the antenna cover by an upper compression plate and a lower compression plate.

9. The connector assembly of claim 8 wherein the flexible sealing structure further comprises an upper flange clamped to a flange on the connector housing.

10. The connector assembly of claim 1 wherein the flexible sealing structure further comprises an inward flange which overlaps a flange on the connector housing.

11. An antenna assembly comprising:

an antenna within an antenna cover;

a connector block attached to an inner structure within the antenna cover, the connector block including a connector mount having at least one connector and a connector housing enclosing the at least one connector, the connector mount extending through an opening in the antenna cover, the opening providing clearance sufficient to allow for movement of the antenna cover relative to the connector mount due to a difference in coefficient of thermal expansion of the antenna cover and the inner structure; and a flexible sealing structure attached to the connector mount and attached to the antenna cover dimensioned to enclose at least a portion of the connector mount that extends outside the antenna cover so as to form a flexible weather resistant seal between the antenna cover and the connector mount while allowing movement of the connector mount relative to the antenna cover.

12. The antenna assembly of claim 11 wherein the flexible sealing structure comprises a weather resistant elastomer.

13. The antenna assembly of claim 11 wherein the connector mount is attached to a metal reflector within the antenna cover which serves as a frame for the antenna.

14. The antenna assembly of claim 13 wherein the connector mount is attached to the reflector by a bracket attached to a reflector.

15. The antenna assembly of claim 11 wherein the antenna cover is a single extrusion thermoplastic cover.

16. The antenna assembly of claim 11 wherein the antenna cover has a separately formed rear cover and wherein the flexible sealing structure is attached to the rear cover.

17. The antenna assembly of claim 11 wherein the flexible sealing structure further comprises a lower flange which is clamped to the antenna cover by an upper compression plate and a lower compression plate.

18. The antenna assembly of claim 17 wherein the flexible sealing structure further comprises an upper flange clamped to a flange on the connector housing.

19. The antenna assembly of claim 11 wherein the flexible sealing structure further comprises an inward flange which overlaps a flange on the connector housing.

* * * * *